United States Patent [19]

Moulton et al.

[11] Patent Number: 4,916,415

[45] Date of Patent: Apr. 10, 1990

[54] BALANCED, IMPEDANCE MATCHED, COUPLING DEVICE

[75] Inventors: Clifford H. Moulton, Portland; Valdis E. Garuts, Beaverton, both of Oreg.

[73] Assignee: Tektronix, Inc., Beaverton, Oreg.

[21] Appl. No.: 297,211

[22] Filed: Jan. 17, 1989

[51] Int. Cl.[4] ..... H01P 5/10

[52] U.S. Cl. ..... 333/26; 333/127

[58] Field of Search ..... 333/25, 26; 343/859

[56] References Cited

U.S. PATENT DOCUMENTS 2,517,968 8/1950 Brown ..... 333/26

3,311,850 3/1967 Podell ..... 333/26 X

OTHER PUBLICATIONS

Bosshard et al., *Nanosecond Bifilar Wound Transformers*, The Review of Scientific Instruments, vol. 38, No. 7, Jul. '67, pp. 942–945.

H. Shuhao, *The Balun Family*, Microwave Journal, Sep. '87, pp. 227–229.

*Primary Examiner*—Paul Gensler

*Attorney, Agent, or Firm*—John P. Dellett

[57] ABSTRACT

A single-ended to differential coupling device includes an input coaxial transmission line feeding sections of output coaxial transmission line across a break or gap between the outer conductors of the output transmission lines. A shunt resistor across the input transmission line and a series resistor interposed between the center conductors of the output transmission lines provide exact impedance matching in conjunction with plural ferrite toroids disposed about at least one of the transmission lines to prevent shorting of the input signal.

28 Claims, 4 Drawing Sheets

BALANCED, IMPEDANCE MATCHED, COUPLING DEVICE

BACKGROUND OF THE INVENTION

The present invention relates to a device for coupling between a single-ended circuit and a balanced circuit, and particularly to such a device which is impedance matched.

A large number of devices are available for converting between single-ended and push-pull signal circuits at high frequencies and are often referred to as baluns. These devices can perform impedance transformation and generally behave as high-frequency transformers having a single-ended side and a push-pull side. The various designs differ in regard to the frequency band for which they are intended, the power handling capacity, and the circuit impedances. The impedance transformation can be accomplished by transformer turns ratio, and by various configurations of series and parallel transmission lines. Many of these devices are awkward in size and may not provide an accurate impedance transformation. For instance, if the impedance transformation is a function of a turns ratio between coils, only a ratio between integral numbers of turns is ordinarily available and is not easily changed from one application to another.

SUMMARY OF THE INVENTION

In accordance with the present invention in a principal embodiment thereof, a single-ended to differential coupling device comprises an input coaxial transmission line or cable receiving an unbalanced input, and a pair of output coaxial transmission lines or cables (which may actually comprise two parts of the same line) supplying balanced outputs, i.e., in exact phase opposition. The inner and outer conductors of the first or input coaxial line are respectively joined to the outer conductors of the balanced output lines, while the inner conductors of the latter are joined together. Since the outer conductors of all cables are at ground reference, additional impedance is inserted in an output branch in order to avoid shunting the input signal to ground. In its preferred form, one or more ferrite toroids are disposed in coaxial relation to the line outer conductor driven by the center conductor of the input line.

In order to achieve an impedance match at the input, a shunt resistance is disposed across the input cable, and in order to provide impedance match at the branched outputs, a second resistor is interposed between the center conductors of the differential output cables at the same physical location where the outer conductors thereof are fed, i.e., at the location of the slot or break between the output cables. The actual slot can be quite narrow, and substantially exact balance can be achieved.

It is accordingly an object of the present invention to provide an improved single-ended to differential coupling device characterized by exact impedance transformation.

It is another object of the present invention to provide an improved single-ended to differential coupling device which is simple in construction and efficient in operation.

It is a further object of the present invention to provide an improved single-ended to differential coupling device characterized by very high bandwidth.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

DETAILED DESCRIPTION

Figure 1:
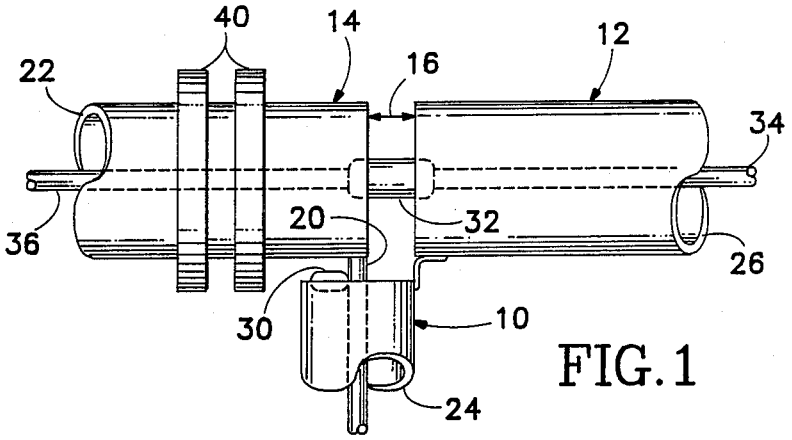
FIG. 1 is a side view of a single-ended to differential coupling device according to the present invention.
Figure 2:
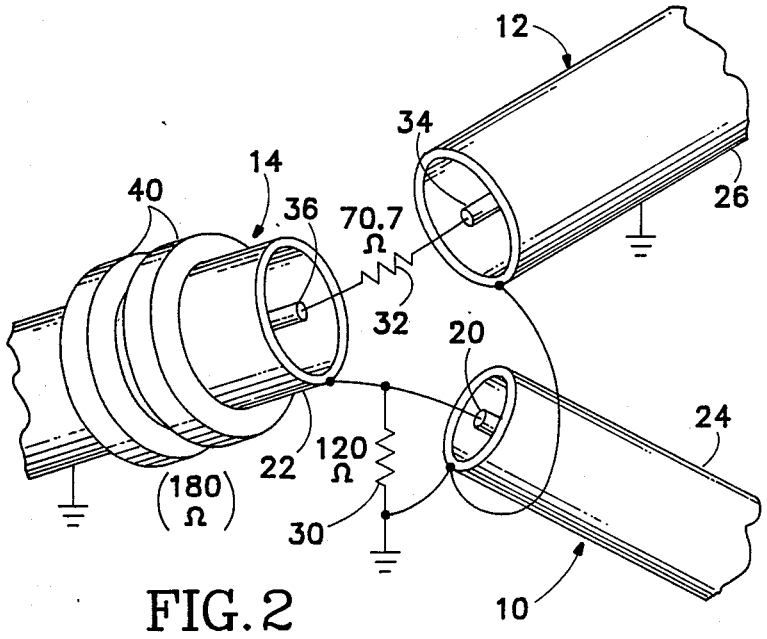
FIG. 2 is an exploded view for schematically illustrating connection of the FIG. 1 device.
Figure 3:
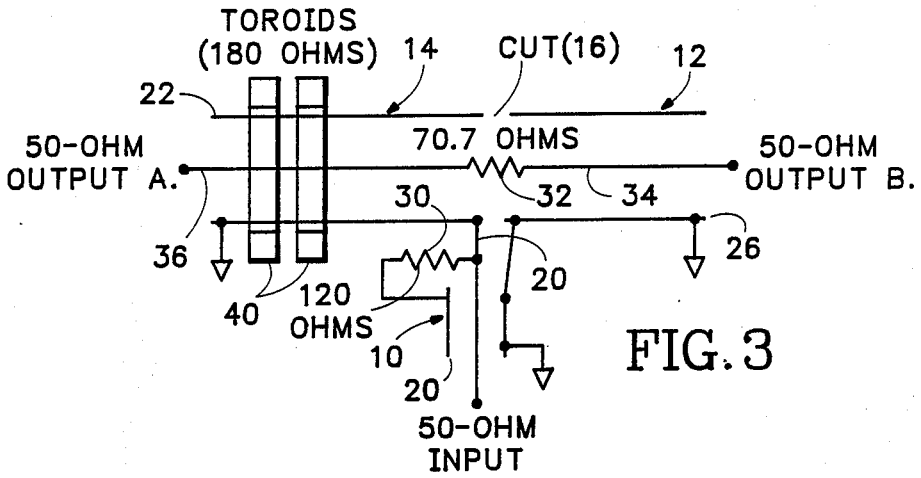
FIG. 3 is a schematic diagram of the same device.

Referring to FIGS. 1–3, a single-ended to differential coupling device according to the present invention comprises a first or input transmission line suitably taking the form of a coaxial transmission line or cable 10, a second transmission line suitably in the form of a coaxial transmission line or cable 12, and a third transmission line suitably in the form of a coaxial transmission line or cable 14. For explanatory purposes it will be assumed that a single-ended input is provided to cable 10 (by means not shown), and it is intended to provide balanced output signals at the remote ends of cables 12 and 14. The exterior conductor of each of the coaxial cables is referenced to the same source of reference potential, i.e., grounded.

In the preferred form of the present invention, the input coaxial cable 10 is joined directly to the output cables 12 and 14 at the location of a slot or gap 16 between the outer conductors of the output cables 12 and 14. In fact, the cables 12, 14 may form a part of the same extended transmission line or cable, having only the outer conductor thereof cut or separated to form the gap 16. The inner conductor 20 of coaxial cable 10 is joined directly to the outer conductor 22 of cable 14, while the outer conductor 24 of cable 10 is joined directly to the outer conductor 26 of cable 12, e.g. by way of conductive tab 28. Thus, the gap distance can be approximately the spacing between the inner and outer conductors of cable 10 or narrower. Highest frequency performance of the device is improved by a physically short width of cut in the differential output outer conductor.

For impedance matching purposes, a shunt resistor 30 is disposed between the inner and outer conductors of cable 10 adjacent the gap, while a series resistor 32 is serially interposed between inner conductors 34 and 36 of coaxial cables 12 and 14, also adjacent the gap. As will hereinafter be more fully described, these resistors produce desired impedance matches at both the input and at the outputs of the device, but embodiments of the invention, absent one or the other of these resistors, can produce only input matching or output matching. When the resistor 32 is employed to provide the desired output matching, the gap 16 is made somewhat larger than it might otherwise be, to allow insertion of the resistor. However, very acceptable results are obtained with realizable resistors.

The invention will be explained with reference to the somewhat schematic illustrations of FIGS. 2 and 3, it being understood, especially with respect to FIG. 2, that the showing is for illustration purposes only and actually the gap or spacing of the various coaxial transmission lines is advantageously configured as discussed above with respect to FIG. 1. Also, the component values discussed and shown on the drawings are for purposes of illustration only, and assume a 50 ohm unbalanced input to a pair of 50 ohm outputs, balanced with respect to one another.

As hereinafter more fully discussed, ferrite toroids 40 are preferably disposed in surrounding relation to the outer conductor 22 of coaxial cable 14 between the input feed end thereof adjacent gap 16, and the grounded or output feed end thereof. The purpose of these toroids is to establish an impedance to ground that avoids shunting the input cable central conductor 20 to ground.

The present invention employs resistors 30 and 32 to provide, in part, an impedance matching function which can be accurately selected in accordance with the values of these resistors. As will be appreciated by those skilled in the art, the device is therefore not completely lossless, but is designed for low signal levels at the highest possible frequency ranges as generally associated with measurement by oscilloscope systems or for passing logic signals associated with digital integrated circuits. A bandwidth well over 5 Ghz is achieved in all cases.

Design for a simple resistive matching network for use, for example, at low frequencies to match from a 50 ohm input to push-pull 50 ohm outputs might employ two 70.7 ohm resistors. One resistor would be disposed in shunt relation across the single-ended input, while the other would be connected in series in the 100 ohm load circuit (two 50 ohm circuits in series). The present invention realizes this general type of impedance match for extremely high frequencies with a well balanced amplitude and phase output. The resistor 32 suitably has a 70.7 ohm value as described above, but is in series with the central conductors of the output transmission lines. However, the shunt resistor 30 across the input transmission line has a higher value, approximately 120 ohms in the specific example, since in the preferred embodiment resistor 30 is in parallel with an impedance between the central conductor 20 of cable 10 and ground produced by the ferrite toroids 40 used to raise the shortcircuit impedance in parallel with the input signal. This impedance is raised to approximately 180 ohms. It will be seen that the value of 180 ohms in parallel with the 120 ohm value of resistor 30 advantageously provides approximately the 70.7 ohms desired for the input impedance match.

Other means may employed in place of toroids 40 in order to establish the desired impedance to ground in order to prevent shorting of the input cable signal. Thus, coaxial cable 14 may itself be wound or coiled as an inductance, or if a type of twin-line transmission line were to be substituted for coaxial cable 14, the conductors thereof can be wound in a bifiler manner to produce the desired impedance. However, the utilization of the ferrite toroids has been found to be an advantageously compact and efficient manner of providing the desired impedance value. A pair of ferrite toroids are useful in raising the shunt value of impedance until the signal frequency of interest drops below about 5 MHz. While larger ferrite toroids, or more of them, can extend the low frequency performance, the frequency of 5 MHz is adequate for most purposes for which the device was intended. However, it would be of less advantage to materially reduce the impedance contributed by the toroids to, say, the 70.7 ohm value without employing resistor 30 in parallel therewith. The toroids increase the impedance to ground of the outer conductor, but the balanced output, i.e., as produced at the remote end of cable 14, is substantially unaffected by the toroids since the inner conductor and outer conductor transmission line signal currents produce opposing or canceling flux in the toroids.

Figure 4:
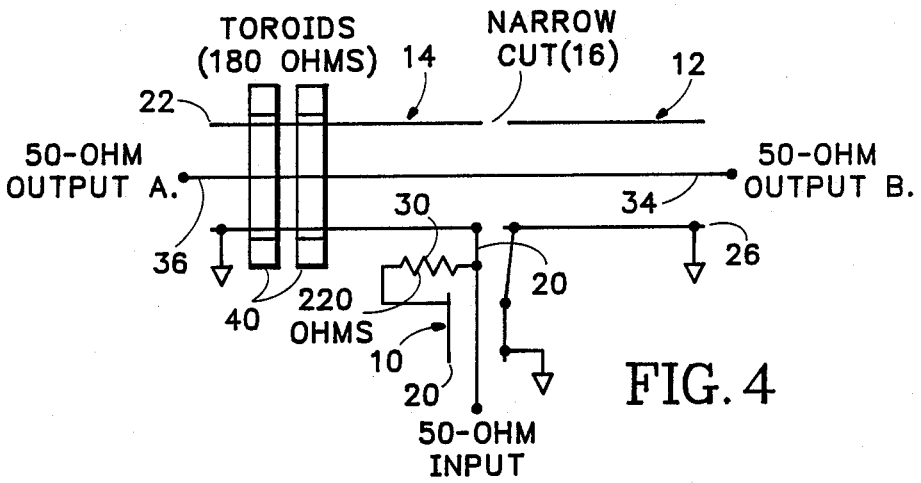
FIG. 4 is a schematic diagram for a device according to the present invention providing input circuit matching.

Referring to FIG. 4, an embodiment is schematically illustrated which omits the resistor 32, as previously mentioned, and supplies an impedance match only for the 50 ohm input at the remote end of cable 10. Considering 50 ohm loads coupled at the outputs of both coaxial lines 14 and 12, and the 180 ohm value in parallel with the input provided by the effect of toroids 40, a 220 ohm resistor 30 is in this case utilized to provide input matching.

Figure 5:
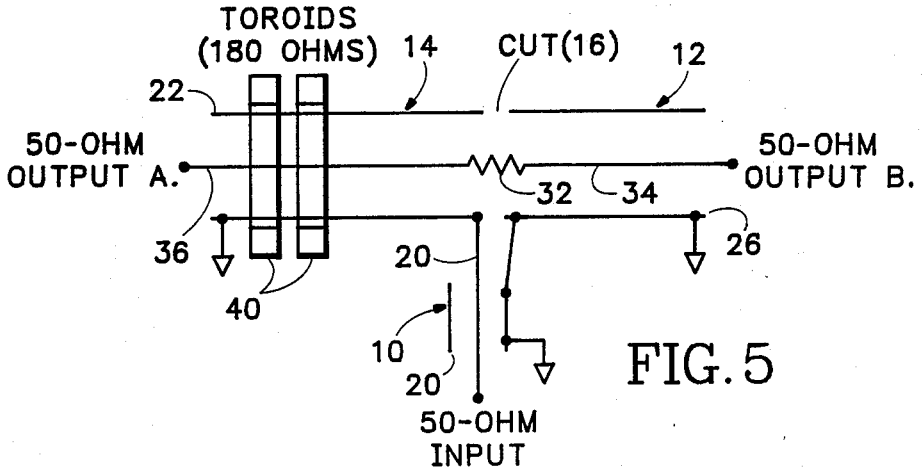
FIG. 5 is a schematic diagram of an embodiment according to the present invention providing output circuit matching.

Further considering FIG. 5, an embodiment is illustrated wherein output matching is provided at the remote ends of coaxial cables 12 and 14, but not at the input of cable 10. In this case, the value of resistor 32 is suitably 61 ohms In reference to FIGS. 6, 7 and 8, embodiments are illustrated in schematic form and are respectively similar to the embodiments of FIGS. 3, 4 and 5 inasmuch as according to FIG. 6 both input and output impedance matching are provided, according to FIG. 7 only input impedance matching is provided, and in FIG. 8 only output matching is provided. However, in each of these versions, an additional ferrite toroid 44 is disposed in surrounding relation to both coaxial transmission lines 10 and 12. It will be appreciated that the remote ends of each of the transmission lines (i.e., the input end of line 10 and the output ends of lines 12 and 14) are grounded, and the additional toroid provides extra isolation between the juncture of the three lines and ground. Of course, toroid 44 can take the form of multiple toroids formed of ferrite material.

Figure 6:
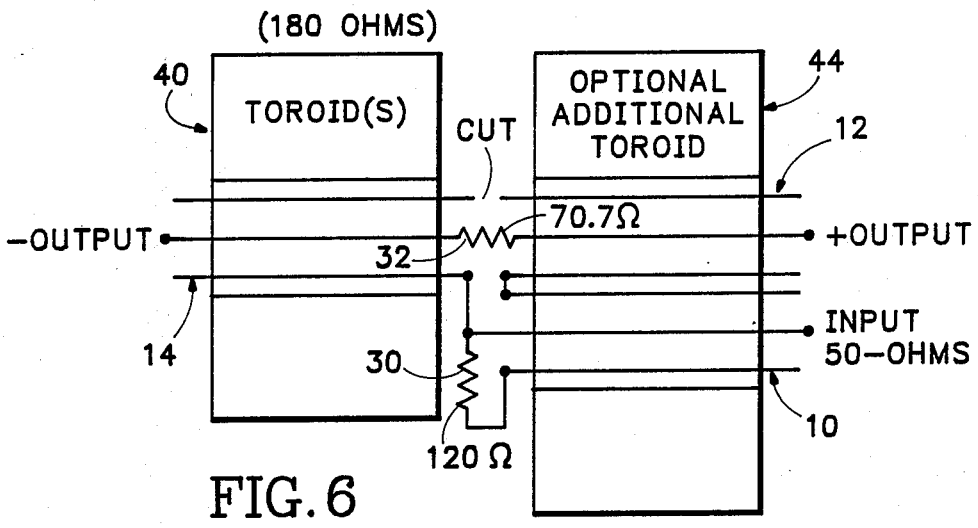
FIG. 6 is a schematic diagram for a device according to the present invention having additional means for adding impedance as well as impedance matching means for input and output circuits.
Figure 7:
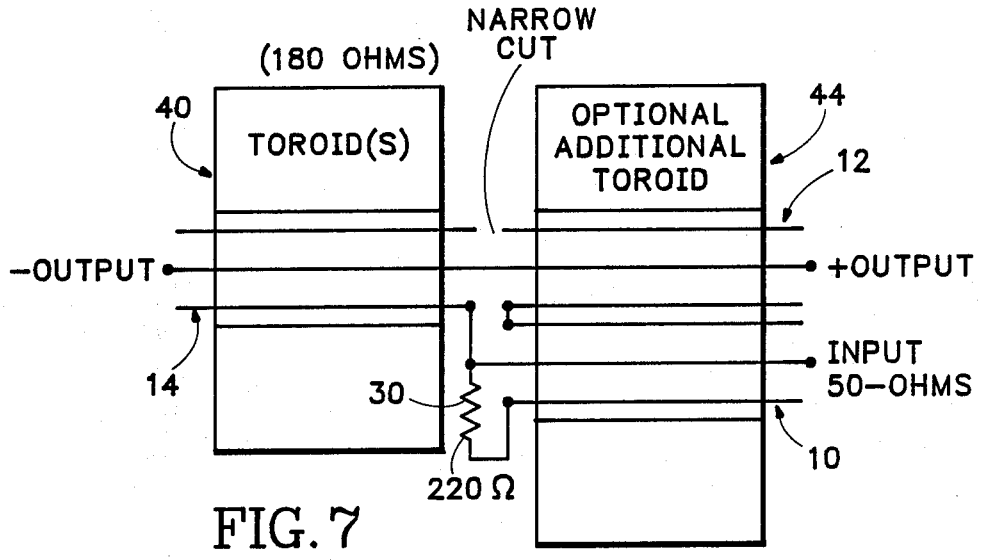
FIG. 7 is a schematic diagram for a device according to the present invention having additional impedance means and means providing input circuit matching.
Figure 8:
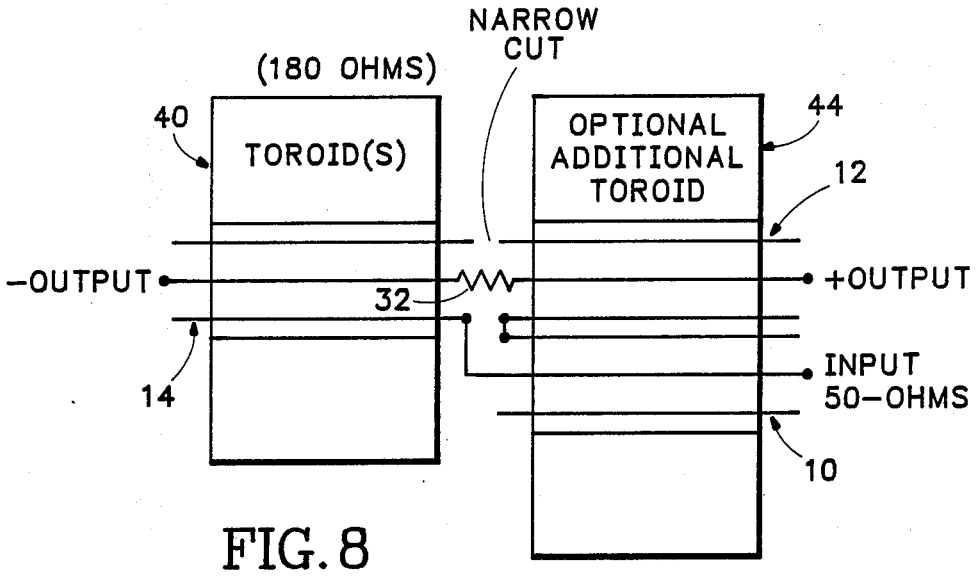
FIG. 8 is a schematic diagram for a device according to the present invention having additional impedance means and means for providing output circuit matching.

In accordance with yet further embodiments, the toroids 40 can be omitted from the configurations illustrated in FIGS. 6, 7 and 8, in which case the toroid or toroids 44 are employed to provide an impedance preventing shunting of the signal at the output end of line 10. Thus, toroid 44 isolates the common ground at the remote (right hand) ends of both lines 10 and 12 from the juncture between input line 10 and the output lines. However, it is preferred to employ only the toroid or toroids 40 about coaxial transmission 14 rather than only the toroid or toroids 44.

While the invention has been described in connection with coaxial transmission lines or cables, and although such embodiment is preferred, it will appreciated that other forms of balanced lines may be substituted therefor, for example, twin line or twisted pair. Furthermore, various transmission lines can be formed to provide the desired inductive reactance, for example, in the leg corresponding to output cable 14. Thus, as mentioned, the transmission lines in leg 14 can be themselves wound or coiled into an inductor of appropriate length to provide the desired impedance, or may be bifiler wound on a ferrite core. Alternatively, coils having mutual inductance can be inserted in the conductors of the transmission line where the additional impedance is provided. Again, however, the configuration first above described and illustrated is preferred since it is much more compact and more easily balanced than the various alternatives discussed with respect to substituting other inductive means for the toroids.

Moreover, although the present invention is described in connection with a single-ended input and a balanced or push-pull output, it will be appreciated the input and output functions can be reversed, i.e., to provide a push-pull input and a single-ended output.

While several embodiments of the present invention have been shown and described, it will thus be apparent to those skilled in the art that many changes and modifications may be made without departing from the invention in its broader aspects. The appended claims are therefore intended to cover all such changes and modifications as fall within the true spirit and scope of the invention.

We claim:

1. A single-ended to differential coupling device a first transmission line including first and second spaced conductors and characterized by carrying a first signal with respect to a point of common reference potential;

second and third transmission lines characterized by carrying second and third signals with respect to said point of common reference potential and each including first and second spaced conductors, wherein said second and third signals are balanced and out of phase with respect to said point of common reference potential; and means for coupling said first transmission line to both said second and third transmission lines including means coupling a first conductor of said first transmission line to a first conductor of said second transmission line, means coupling the second conductor of said first transmission line to the first conductor of the third transmission line, and means intercoupling the second conductors of said second and third transmission lines;

at least one of said transmission lines having impedance added thereto to avoid shorting the first signal with respect to the point of common reference potential;

wherein the means intercoupling the second conductors of the second and third transmission lines comprises a second impedance for bringing about a matched condition for means coupled to the second and third transmission lines.

2. The device according to claim 1, wherein said impedance is added by providing at least one toroidal core formed of a material capable of supporting a magnetic field in linking relation with both the first and second conductors of said third transmission line.

3. The device according to claim 1 wherein said impedance is added by providing at least one toroidal core formed of a material capable of supporting a magnetic field in linking relation with the first and second conductors of said first and second transmission lines.

4. The device according to claim 1 wherein said impedance is added by providing at least one toroidal core formed of a material capable of supporting a magnetic field in linking relation with both the first and second conductors of said third transmission line, and further including a second toroidal core formed of a material capable of supporting a magnetic field in linking relation with the first and second conductors of said first and second transmission lines.

5. The device according to claim 1 wherein said first, second and third transmission lines comprise coaxial transmission lines.

6. The device according to claim 1 further including a third impedance in shunt relation with the first and second conductors of said first transmission line for bringing about a matched condition for means coupled to the first transmission line.

7. The device according to claim 6 wherein said impedance is added by providing at least one toroidal core formed of a material capable of supporting a magnetic field in linking relation with both the first and second conductors of said third transmission line.

8. The device according to claim 6 wherein said impedance is added by providing at least one toroidal core formed of a material capable of supporting a magnetic field in linking relation with the first and second conductors of said first and second transmission lines.

9. The device according to claim 6 wherein said impedance is added by providing at least one toroidal core formed of a material capable of supporting a magnetic field in linking relation with both the first and second conductors of said third transmission line, and further including a second toroidal core formed of a material capable of supporting a magnetic field in linking relation with the first and second conductors of said first and second transmission lines.

10. The device according to claim 6 wherein said first, second and third transmission lines comprise coaxial transmission lines.

11. The device according to claim 6 further including at least one toroidal core formed of a material capable of supporting a magnetic field disposed in linking relation to at least one of said transmission lines.

12. The device according to claim 6 wherein said impedance is added by providing at least one toroidal core formed of a material capable of supporting a magnetic field in linking relation with at least one of said transmission lines, and wherein said third impedance is selected to provide said matched condition in conjunction with said value of said added impedance.

13. A single-ended to differential coupling device comprising:

a first transmission line including first and second spaced conductors and characterized by carrying a first signal with respect to a point of common reference potential;

second and third transmission lines characterized by carrying second and third signals with respect to said point of common reference potential and each including first and second spaced conductors, wherein said second and third signals are balanced and out of phase with respect to said point of common reference potential;

means for coupling said first transmission line to both said second and third transmission lines including means coupling a first conductor of said first transmission line to a first conductor of said second transmission line, means coupling the second conductor of said first transmission line to the first conductor of the third transmission line, and means intercoupling the second conductors of said second and third transmission lines;

at least one of said transmission lines having impedance added thereto to avoid shorting the first signal with respect to the point of common reference potential; and further including an additional impedance in shunt relation with the first and second conductors of said first transmission line for bringing about a matched condition for means coupled to the first transmission line.

14. The device according to claim 13 wherein the first mentioned impedance is added by providing at least one toroidal core formed of a material capable of supporting a magnetic field in linking relation with at least one of said transmission lines, and wherein said additional impedance is selected to provide said matched condition in conjunction with the value of said added impedance.

15. The device according to claim 13 wherein the first mentioned impedance is added by providing at least one toroidal core formed of a material capable of supporting a magnetic field in linking relation with both the first and second conductors of said third transmission line.

16. The device according to claim 13 wherein the first mentioned impedance is added by providing at least one toroidal core formed of a material capable of supporting a magnetic field in linking relation with the first and second conductors of said first and second transmission lines.

17. The device according to claim 13 wherein the first mentioned impedance is added by providing at least one toroidal core formed of a material capable of supporting a magnetic field in linking relation with both the first and second conductors of said third transmission line, and further including a second toroidal core formed of a material capable of supporting a magnetic field in linking relation with the first and second conductors of said first and second transmission lines.

18. The device according to claim 13 wherein said first, second and third transmission lines comprise coaxial transmission lines.

19. A single-ended to differential coupling device comprising:

a first coaxial transmission line having an outer conductor and an inner conductor;

second and third coaxial transmission lines each having an outer conductor and an inner conductor; and means for coupling said first coaxial transmission line to both said second and third coaxial transmission lines including means coupling the outer conductor of the first coaxial transmission line to the outer conductor of the second coaxial transmission line, means coupling the inner conductor of the first coaxial transmission line to the outer conductor of the third coaxial transmission line, and means intercoupling the inner conductors of said second and third coaxial transmission lines;

wherein the outer conductors of the second and third coaxial transmission lines are in substantial alignment and are separated by a narrow gap, with said outer and inner conductors of the first coaxial transmission line being respectively joined to the outer conductors of the second and third coaxial transmission lines directly across said gap; and wherein the means intercoupling the inner conductors of the second and third coaxial transmission lines comprises a resistor therebetween in the region of said gap for bringing about a matched condition for means coupled to the remote ends of the second and third coaxial transmission lines.

20. The device according to claim 19 further including at least one toroidal core formed of a material capable of supporting a magnetic field disposed in linking relation to at least one of said transmission lines.

21. The device according to claim 19 including a resistor disposed in shunt relation to the inner and outer conductors of said first transmission line proximate said gap separating the outer conductors of the second and third coaxial transmission lines for bringing about a matched condition for means coupled to the remote end of the first coaxial transmission line.

22. The device according to claim 21 further including at least one toroidal core formed of a material capable of supporting a magnetic field disposed in linking relation to said third coaxial transmission line for bringing about an impedance with respect to common ground at the outer conductor of said third transmission line to prevent shunting of said first transmission line, the value of said last mentioned resistor being selected to provide said matched condition in conjunction with the value of said impedance in parallel relation therewith.

23. A single-ended to differential coupling device comprising:

a first coaxial transmission line having an outer conductor and an inner conductor;

second and third coaxial transmission lines each having an outer conductor and an inner conductor; and means for coupling said first coaxial transmission line to both said second and third coaxial transmission lines including means coupling the outer conductor of the first coaxial transmission line to the outer conductor of the second coaxial transmission line, means coupling the inner conductor of the first coaxial transmission line to the outer conductor of the third coaxial transmission line, and means intercoupling the inner conductors of said second and third coaxial transmission lines;

wherein the outer conductors of the second and third coaxial transmission lines are in substantial alignment and are separated by a narrow gap, with said outer and inner conductors of the first coaxial transmission line being respectively joined to the outer conductors of the second and third coaxial transmission lines directly across said gap; and including a resistor disposed in shunt relation to the inner and outer conductors of said first transmission line proximate said gap separating the outer conductors of the second and third coaxial transmission lines for bringing about a matched condition for means coupled to the remote end of the first coaxial transmission line.

24. The device according to claim 23 further including at least one toroidal core formed of a material capable of supporting a magnetic field disposed in linking relation to said third coaxial transmission line for bringing about an impedance with respect to common ground at the outer conductor of said third transmission line to prevent shunting of said first transmission line, the value of said resistor being selected to provide said matched condition in conjunction with the value of said impedance in parallel relation therewith.

25. The device according to claim 24 wherein said means intercoupling the inner conductors of the second and third coaxial transmission lines comprises a resistor therebetween located in the region of said gap for bringing about a matched condition for means coupled to the remote ends of the second and third coaxial transmission lines.

26. The device according to claim 23 wherein said means intercoupling the inner conductors of the second and third coaxial transmission lines comprises s resistor therebetween located in the region of said gap for bringing about a matched condition for means coupled to the remote ends of the second and third coaxial transmission lines.

27. The device according to claim 23 further including at least one toroidal core formed of a material capable of supporting a magnetic field disposed in linking relation to at least one of said transmission lines.

28. The device according to claim 23 further including at least one toroidal core formed of a material capable of supporting a magnetic field disposed in linking relation to said third coaxial transmission line for bringing about an impedance with respect to common ground at the outer conductor of said third transmission line to prevent shunting of said first transmission line, the value of said resistor being selected to provide said matched condition in conjunction with the value of said impedance in parallel relation therewith.

* * * * *